US008328576B2

(12) United States Patent
Chen et al.

(10) Patent No.: US 8,328,576 B2
(45) Date of Patent: Dec. 11, 2012

(54) CABLE CONNECTOR ASSEMBLY

(75) Inventors: Yun-Lung Chen, Tu-Cheng (TW); Kun-Chi Hsieh, Tu-Cheng (TW); Lin Ding, Shenzhen (CN); Wen-Bo Cao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/097,424

(22) Filed: Apr. 29, 2011

(65) Prior Publication Data

US 2012/0088390 A1 Apr. 12, 2012

(30) Foreign Application Priority Data

Oct. 12, 2010 (CN) ..... 2010 1 0504182

(51) Int. Cl.
*H01R 13/627* (2006.01)

(52) U.S. Cl. ..... 439/350

(58) Field of Classification Search ..... 439/541.5, 439/607.01, 608–610, 490, 350–353, 108
See application file for complete search history.

(56) References Cited

U.S. PATENT DOCUMENTS

| | | | | |
|---|---|---|---|---|
| 6,193,555 | B1 * | 2/2001 | Chang | 439/607.09 |
| 6,299,482 | B1 * | 10/2001 | Huang | 439/607.32 |
| 6,561,847 | B1 * | 5/2003 | Xiang et al. | 439/541.5 |
| 7,044,778 | B2 * | 5/2006 | Tanaka | 439/541.5 |

* cited by examiner

*Primary Examiner* — Jean F Duverne
(74) *Attorney, Agent, or Firm* — Altis Law Group, Inc.

(57) ABSTRACT

A cable connector assembly includes a connector and an enclosure. The connector includes a securing plate and a guiding member attached to the securing plate. The enclosure includes a mounting plate and an elastic clipping portion disposed on the mounting plate. A flange is located on the clipping portion. The elastic clipping portion is engaged with the securing plate, and the flange abuts the guiding member.

18 Claims, 6 Drawing Sheets

CABLE CONNECTOR ASSEMBLY

BACKGROUND

1. Technical Field

The present disclosure relates to an electrical cable connector assembly.

2. Description of Related Art

Many connector assemblies used for cables of electronic devices include a connector and an enclosure. The connector is often secured to the enclosure by a plurality of screws. However, it is laborious and very time-consuming to use multiple screws to secure the connector to the enclosure.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
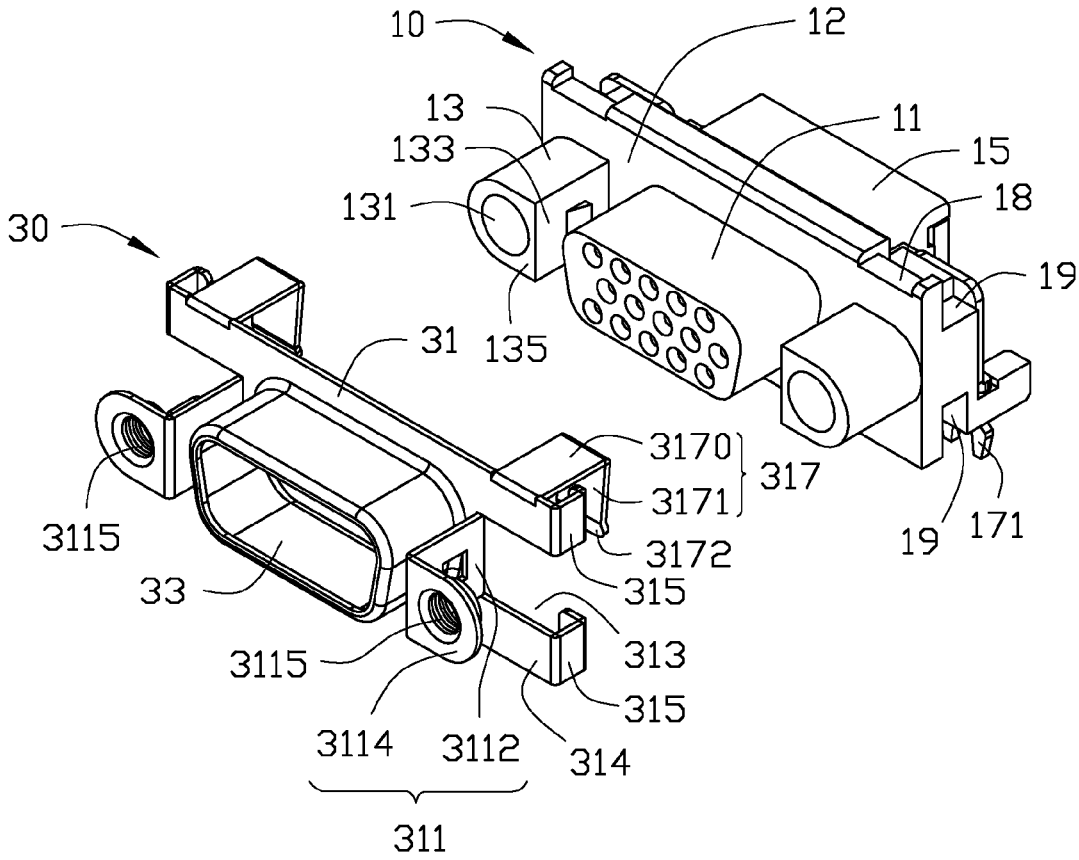
FIG. 1 is an exploded, isometric view of a cable connector assembly in accordance with an embodiment.
Figure 2:
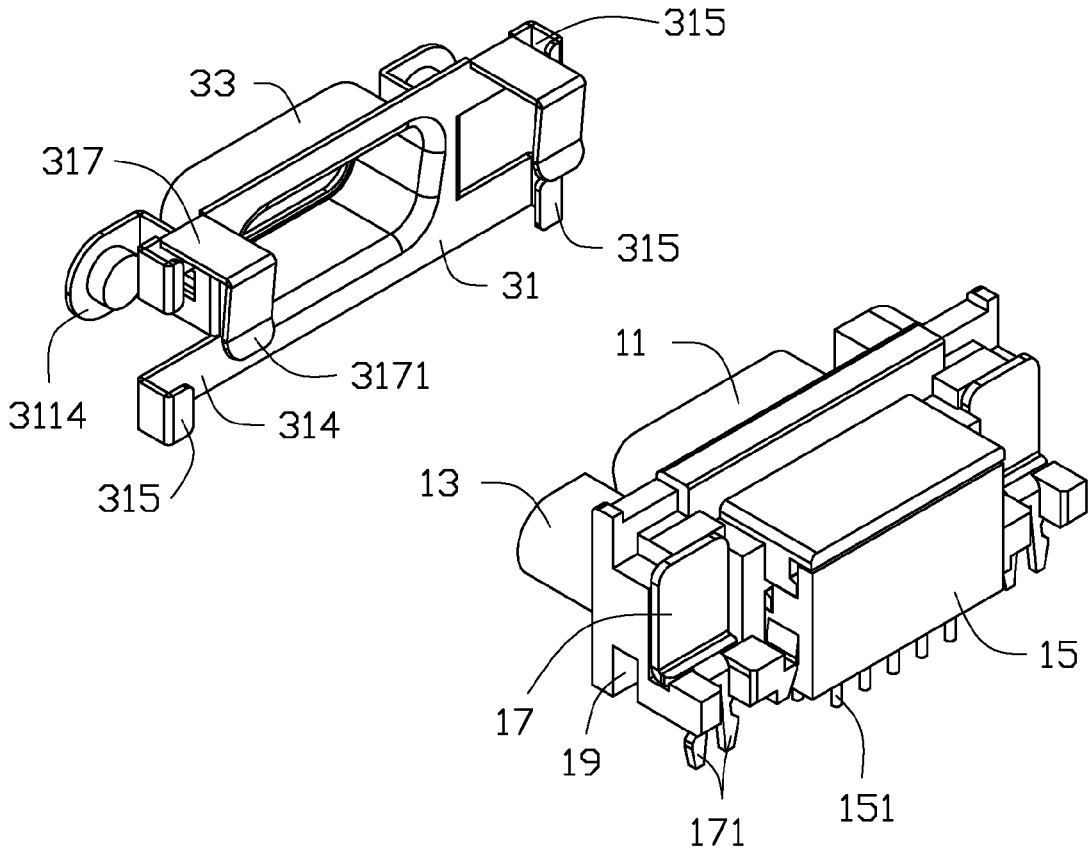
FIG. 2 is similar to FIG. 1, but viewed in a different aspect.

Referring to FIGS. 1-2, a cable connector assembly in accordance with an embodiment includes a connector 10 and an enclosure 30 for securing the connector 10. In an embodiment, the enclosure 30 is made of metal.

The connector 10 includes a securing plate 12, an inserting portion 11 protruding from one side of the securing plate 12, and a connecting portion 15 located the other side of the securing plate 12. Two positioning slots 18 are defined in the upper portion of the securing plate 12, and two pair of cutouts 19 are defined in opposite sides of the securing plate 12. Two supporting posts 13, each with a receiving hole 131, are arranged on opposite sides of the inserting portion 11. Each supporting post 13 includes a first side panel 133 and a second side panel 135 substantially perpendicular to the first side panel 133. In an embodiment, the first side panel 133 is rectangular, and the second side panel 135 is arced.

A plurality of pins 151 extends from a bottom of the connecting portion 15. Two guiding members 17 are arranged on opposite sides of the connecting portion 15. Two ground pins 171, at an acute angle to each other, extend from each guiding member 17. In an embodiment, the ground pins 171 are elastic, and the top edge of each guiding member 17 is aligned with the bottom edge of the positioning slot 18.

The enclosure 30 includes a mounting plate 31 and a receiving portion 33, extending from the mounting plate 31.

Two retaining portions 311 are located on two opposite sides of the receiving portion 33. Each retaining portion 311 includes a mounting piece 3114 and a coupling piece 3112 substantially perpendicular to the mounting plate 31. A mounting post 3115, with a mounting hole (not labeled), extends from the back of the mounting piece 3114. In an embodiment, the mounting post 3115 is configured for mounting a securing post of an electrical cable (not shown) such as a data cable, and the electrical cable is capable of being connected to the inserting portion 11.

A pair of connecting arms 314 are located on opposite sides of each retaining portion 311, and a space 313 is defined between the pair of connecting arms 314. A clasping portion 315 extends from a free end of each connecting arm 314, corresponding to the two pairs of cutouts 19 of the securing plate 12. In one embodiment, each clasping portion 315 is L-shaped. Two clipping portions 317 are connected to a top edge of the mounting plate 31. Each clipping portion 317 includes a connecting piece 3170 and a clipping piece 3171, connected to the connecting piece 3170. A flange 3172 extends from the bottom of the clipping piece 3171. In one embodiment, the connecting piece 3170 is substantially perpendicular to the mounting plate 31 and the clipping piece 3171.

Figure 3:
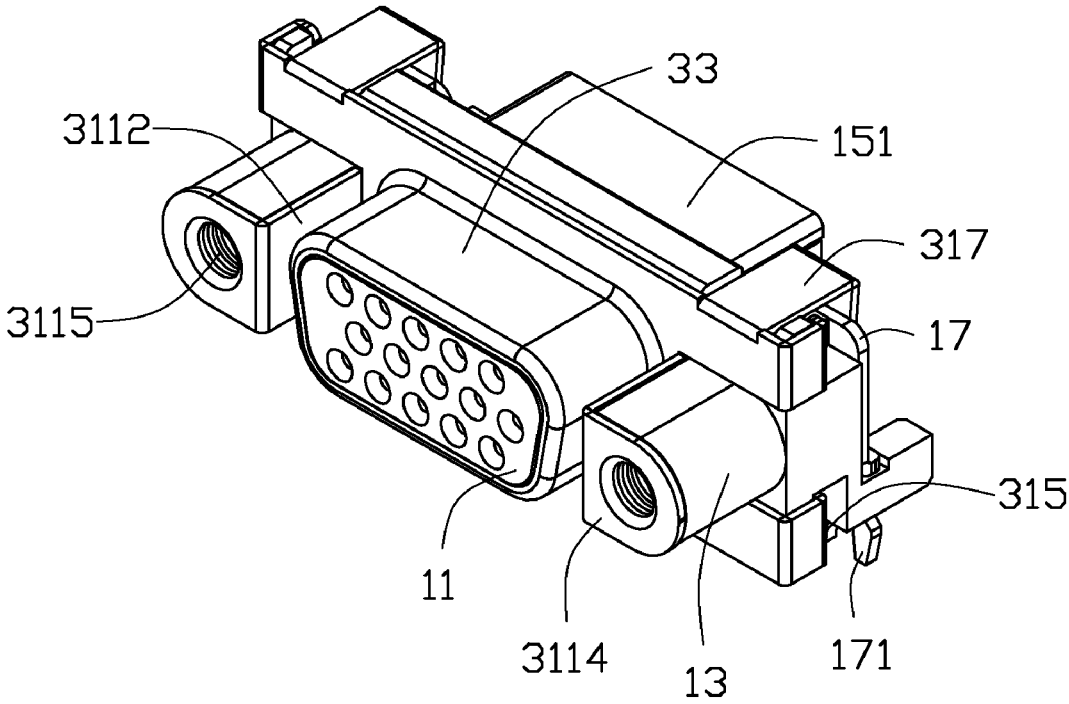
FIG. 3 is an assembled view of FIG. 1.
Figure 4:
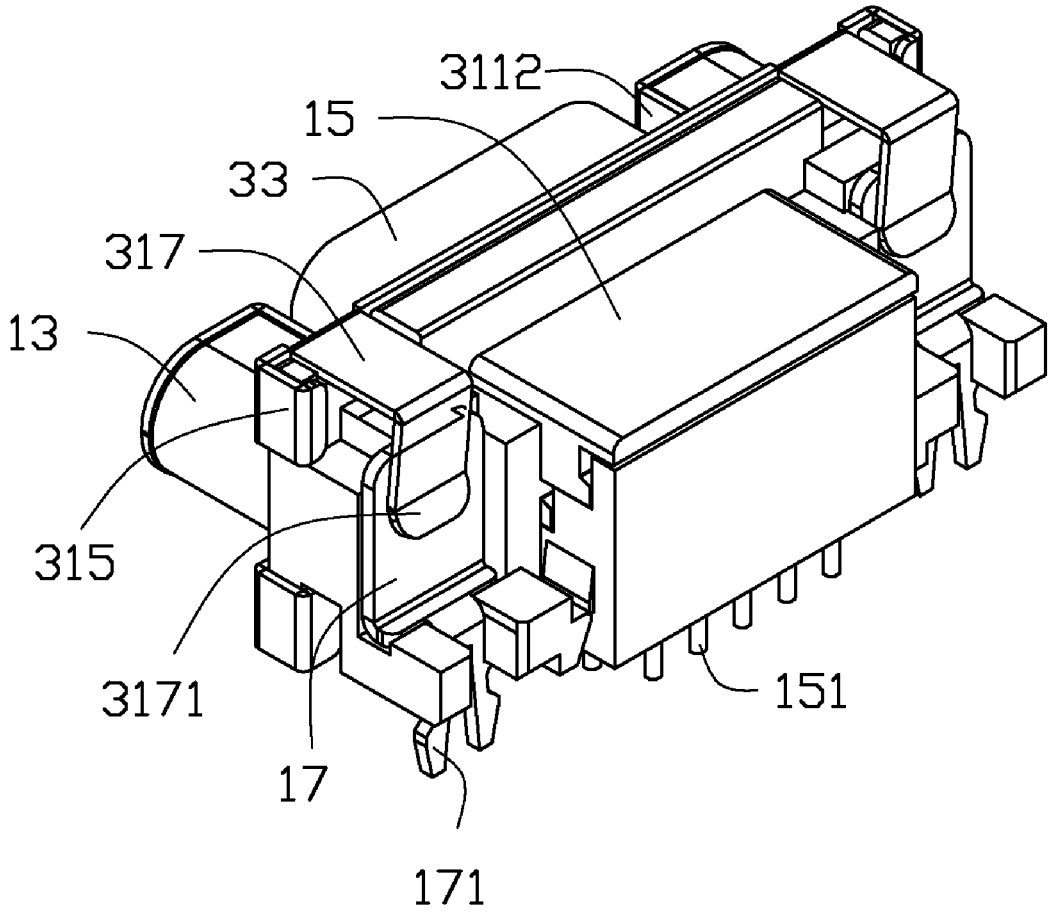
FIG. 4 is similar to the FIG. 1, but viewed in a different aspect.

Referring to FIGS. 3-4, in assembly, the retaining portions 311 are aligned with the supporting posts 13. The enclosure 30 is moved towards the connector 10, until the supporting posts 13 extend through the spaces 313, the inserting portion 11 is received in the receiving portion 33, and the four clasping portions 315 and the two clipping portions 317 abut the securing plate 12. The clasping portions 315 are deformed to pass the edge of the securing plate 12 and then released to be engaged in the two pairs of cutouts 19. The two clipping portions 317 are deformed to pass the edge of the securing plate 12 and then released to be engaged in the two positioning slots 18. The flanges 3172 abut the guiding members 17, so that the connector 10 is electronically connected to the enclosure 30. Thus, the mounting post 3115 is received in the receiving hole 131, and the coupling piece 3112 abuts the first side panel 133.

In disassembly, the clasping portions 315 and the clipping portions 317 are deformed, the clasping potions 315 are disengaged from the cutouts 19, and the clipping portions 317 are removed from the guiding members 17. Therefore, the connector 10 is disengaged from the enclosure 30.

Figure 5:
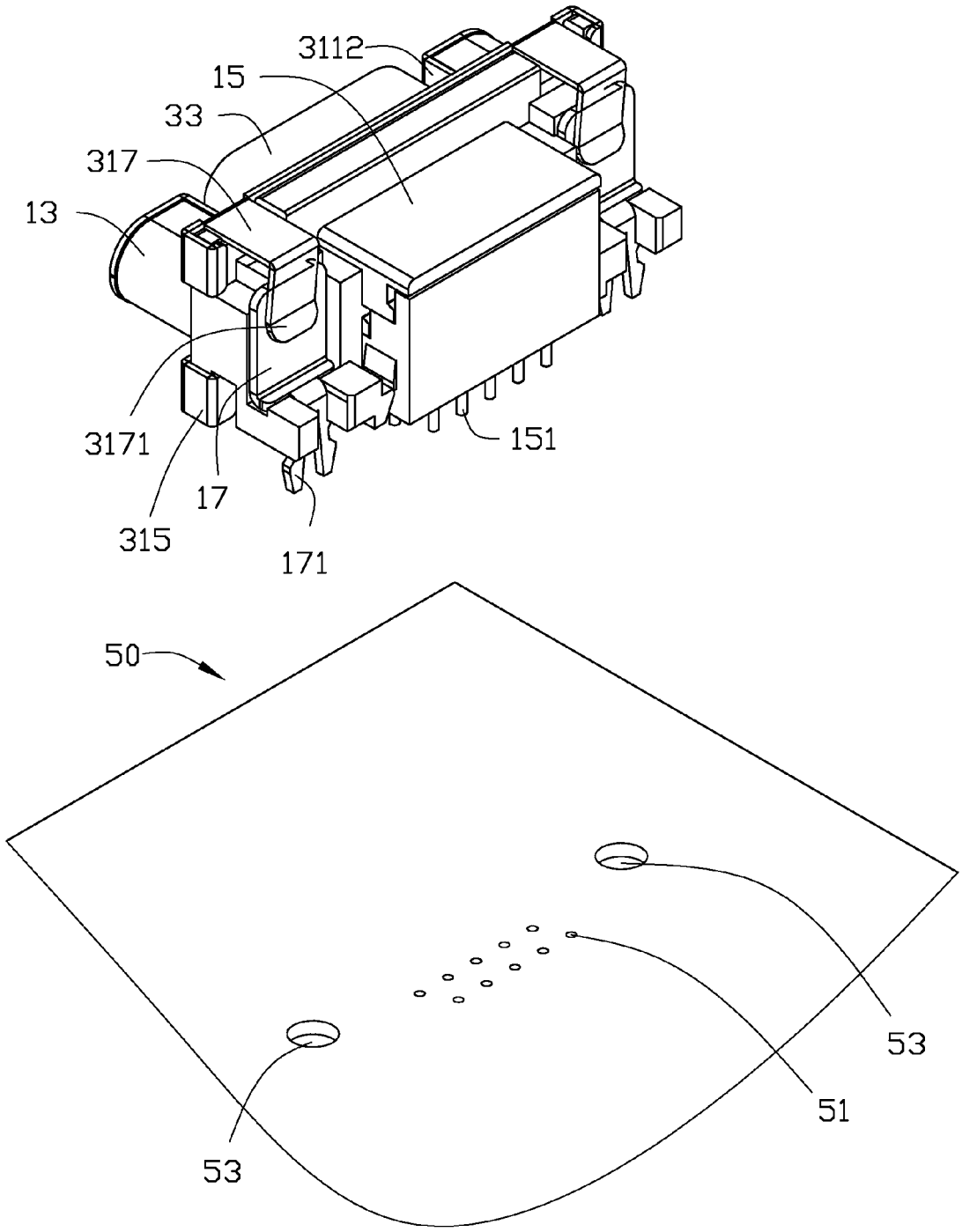
FIG. 5 is an exploded, isometric view of a cable connector assembly and an electronic component in accordance with an embodiment.

Referring to FIG. 5, the cable connector assembly is configured to be attached to an electronic component 50. A plurality of first openings 51, corresponding to the plurality of pins 151, and two second opening 53, corresponding to the two ground pins 171 of each guiding member 17, are defined in the electronic component 50.

Figure 6:
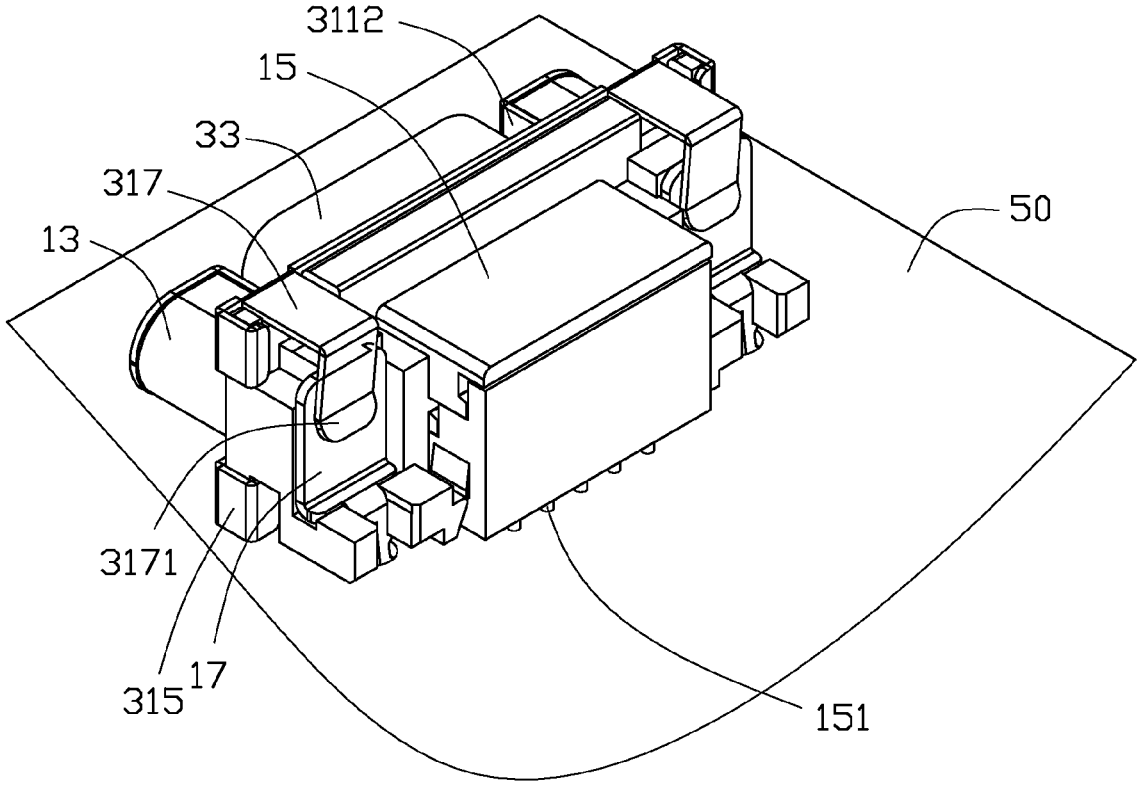
FIG. 6 is an assembled view of FIG. 5.

Referring to FIG. 6, in assembly of the cable connector assembly and the electronic component 50, the plurality of pins 151 of the connector 10 is plunged into the plurality of the first opening 51. The two ground pins 171 of each guiding member 17 are deformed to be inserted into the second opening 53, and released to clip to the bottom of the electronic component 50.

One of ordinary skill in the art will also realize that the invention is not limited to the configuration of the enclosure 30. Rather, other configurations are contemplated by the invention, for example, the clasping portion 315 is long enough to form a touching portion attached to the guiding member 17. The touching portion has a same configuration to the flange 3172.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A cable connector assembly comprising:

a connector comprising a securing plate and a guiding member attached to the securing plate; a supporting post extending from the securing plate; and an enclosure comprising a mounting plate and an elastic clipping portion disposed on the mounting plate, wherein a flange is located on the elastic clipping portion, and a retaining portion extends from the mounting plate;

wherein the supporting post is engaged with the retaining portion, the elastic clipping portion extends through a top edge of the securing plate, so that the flange abuts the guiding member.

2. The cable connector assembly of claim 1, wherein the elastic clipping portion comprises a connecting piece and a clipping piece substantially perpendicular to the connecting piece, and the connecting piece is substantially perpendicular to the mounting plate.

3. The cable connector assembly of claim 2, wherein a positioning slot is defined in the securing plate, and the clipping piece is engaged in the positioning slot.

4. The cable connector assembly of claim 1, wherein the enclosure further comprises a receiving portion extending from the mounting plate, and the connector further comprises an inserting portion received in the receiving portion.

5. The cable connector assembly of claim 1, wherein an elastic clasping portion extends from the mounting plate, a cutout is defined in a side edge of the securing plate, and the elastic clasping portion is received in the cutout.

6. The cable connector assembly of claim 1, wherein the supporting post comprises a first side panel and a second side panel, and the second side panel is substantially perpendicular to the first side panel.

7. The cable connector assembly of claim 6, wherein the retaining portion comprises a coupling piece and a mounting piece connected to the coupling piece, the coupling piece abuts the first side panel, and the mounting piece is attached to the second side panel.

8. The cable connector assembly of claim 7, wherein a mounting post is located on the mounting piece, and the mounting post is configured to secure a cable.

9. The cable connector assembly of claim 1, wherein the guiding member comprises two ground pins configured to engage an electronic component, and the two ground pins are arranged at an acute angle.

10. A cable connector assembly comprising:

a connector comprising a securing plate and a guiding member attached to the securing plate, a positioning slot defined in a top edge of the securing plate, and a cutout defined in a side edge of the securing plate; and an enclosure comprising a mounting plate, an elastic clipping portion disposed on a first side of the mounting plate, and an elastic clasping portion disposed on a second side of the mounting plate, wherein the elastic clipping portion comprising a connecting piece and a flange connected to the connecting piece;

wherein the elastic clasping portion is clipped into the cutout, and the elastic clipping portion extends through the top edge of the securing plate, so that the connecting piece is engaged in the positioning slot, and the flange abuts the guiding member.

11. The cable connector assembly of claim 10, wherein the first side is substantially perpendicular to the second side.

12. The cable connector assembly of claim 10, wherein the elastic clipping portion further comprises a clipping piece substantially perpendicular to the connecting piece, the flange extends from the clipping piece, and the connecting piece is substantially perpendicular to the mounting plate.

13. The cable connector assembly of claim 10, wherein the enclosure further comprises a receiving portion extending from the mounting plate, and the connector further comprises an inserting portion received in the receiving portion.

14. The cable connector assembly of claim 10, wherein a supporting post extends from the securing plate, and a retaining portion is located on the mounting plate and engaged with the supporting post.

15. The cable connector assembly of claim 14, wherein the supporting post comprises a first side panel and a second side panel, and the second side panel is substantially perpendicular to the first side panel.

16. The cable connector assembly of claim 15, wherein the retaining portion comprises a coupling piece and a mounting piece connected to the coupling piece, the coupling piece abuts the first side panel, and the mounting piece is attached to the second side panel.

17. The cable connector assembly of claim 16, wherein a mounting post is located on the mounting piece, and the mounting post is configured to secure a cable.

18. The cable connector assembly of claim 10, wherein the guiding member comprises two ground pins configured to engage an electronic component, and the two ground pins are arranged at an acute angle.

* * * * *